US005638563A

United States Patent [19]

Iura

[11] Patent Number: 5,638,563

[45] Date of Patent: Jun. 17, 1997

[54] BED WITH DUALLY POSITIONABLE HEAD SUPPORT

[76] Inventor: Tadashi Iura, 172-4, Befucho, Matsuyama-shi, Ehime 791, Japan

[21] Appl. No.: 479,441

[22] Filed: Jun. 7, 1995

Related U.S. Application Data

[62] Division of Ser. No. 307,100, Sep. 16, 1994, Pat. No. 5,444,883, which is a continuation of Ser. No. 651,371, Dec. 27, 1991, abandoned.

[30] Foreign Application Priority Data

| | | | |
|---|---|---|---|
| Jun. 26, 1989 | [JP] | Japan | 1-165004 |
| Jun. 30, 1989 | [JP] | Japan | 1-170021 |
| Jul. 1, 1989 | [JP] | Japan | 1-169999 |
| Jul. 1, 1989 | [JP] | Japan | 1-170000 |
| Jul. 8, 1989 | [JP] | Japan | 1-211795 |

[51] Int. Cl.[6] ..... A61G 7/015; A61G 7/05

[52] U.S. Cl. ..... 5/617; 5/613

[58] Field of Search ..... 5/618, 613, 617, 5/622, 616

[56] References Cited

U.S. PATENT DOCUMENTS 2,108,913 2/1938 Bawer ..... 5/617

FOREIGN PATENT DOCUMENTS 1271990 1/1962 France .

*Primary Examiner*—Alexander Grosz

*Attorney, Agent, or Firm*—Nikaido Marmelstein Murray & Oram LLP

[57] ABSTRACT

A posture change-over device is designed so that the posture of the head supporting frame when the back supporting frame is raised and pivoted can be selected from two postures; a posture where the head supporting frame is kept horizontal and a posture where the head supporting frame and the back supporting frame form one plane. Therefore, in the latter case, the bed can be used in the same manner as previous beds capable of raising the upper body, and in the former case, a user can raise his/her upper body without dropping the pillow or articles even when he/she raises his/her back.

2 Claims, 20 Drawing Sheets

BED WITH DUALLY POSITIONABLE HEAD SUPPORT

This application is a divisional application of application Ser. No. 08/307,100 filed Sep. 16, 1994, now U.S. Pat. No. 5,444,883, which in turn is a continuation of application Ser. No. 07/651,371 filed Dec. 27, 1991 (now abandoned) and both of which are incorporated by reference herein in their entirety.

DETAILED DESCRIPTION OF THE INVENTION

1. Industrial Field of Application

This invention relates to a bed capable of raising the upper part of a person's body.

2. Description of the Prior Art

In previous beds capable of raising the upper part of a person's body, the back supporting frame, which forms a plane when raised, forced the user to remove his/her pillow and articles put on the back supporting frame in order to prevent them from falling every time the back supporting frame was raised.

SUMMARY OF THE INVENTION

This invention prevents a pillow and articles put on the front area of the bed from falling when the front area is raised.

In this invention the head supporting frame 21*c* is connected to the front of the back supporting frame 21*b*, which can be raised and pivoted at any angle, so that the frame 21*c* can be bent freely at a joint. A posture change-over means 30 is provided to select between two pivoting states of the head supporting frame 21*c* when the back supporting frame 21*b* is raised and pivoted. The two states are: a first state in which the head supporting frame 21*c* is pivoted in the same plane as the back supporting frame 21*b* and a second state in which the head supporting frame 21*c* is kept in the horizontal posture while pivoting.

In the bed capable of raising the upper part of a person's body according to this invention, the posture change-over means 30 has a rod 28 whose fixed end is connected to the protruding arm 27 under the head supporting frame 21*c* and other end can be fitted to either of a bracket 22*a* of the bed frame or a bracket 29 of the back supporting frame 21*b*.

If the rod is connected to the bracket under the back supporting frame before the back supporting frame is raised, the head supporting frame is held in a condition that the head supporting frame and the back supporting frame form a plane. The plane consisting of the frames, extends upwardly and pivots about a pivot point in the same manner as the previous beds capable of raising the upper part of a person's body. If the rod is connected to the bracket of the bed frame, a parallel link is made, and the head supporting frame is always kept horizontal, thereby preventing a pillow and other articles on the head supporting frame from falling.

DESCRIPTION OF THE EMBODIMENTS

An embodiment of this invention is explained below according to the figures.

Figure 1:
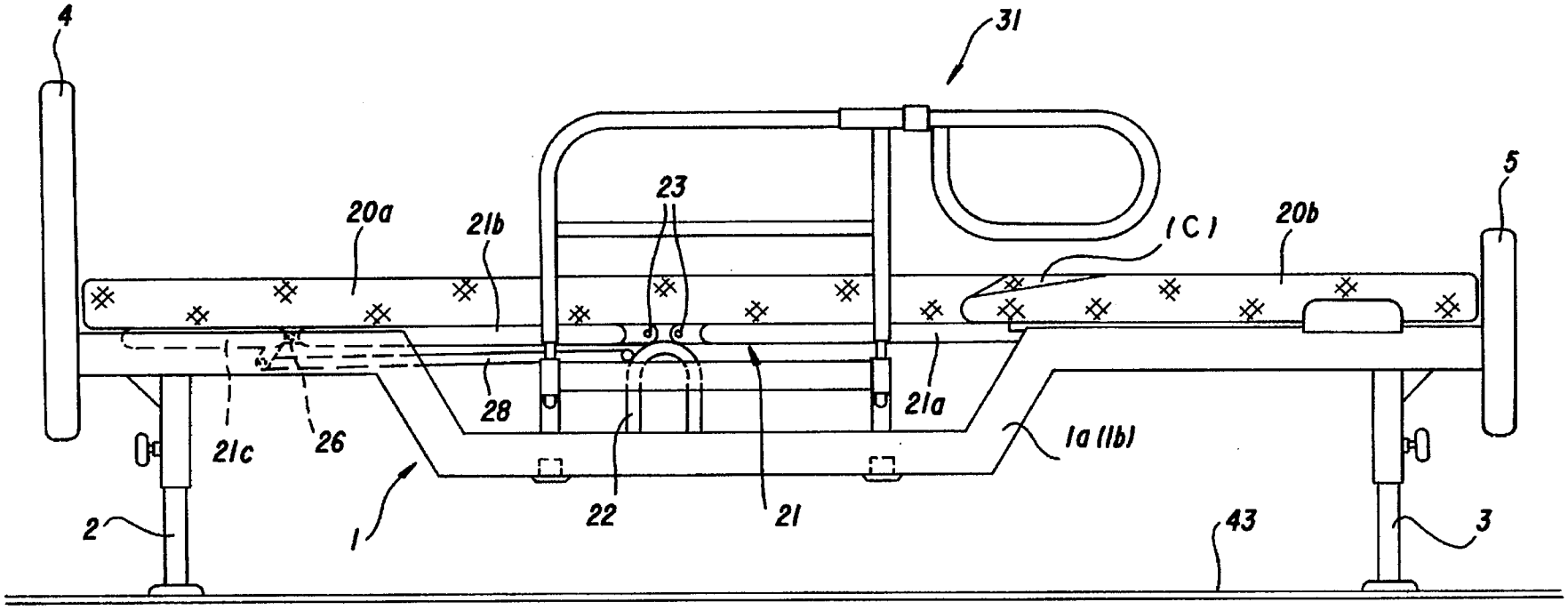
FIG. 1 is a side view of the whole bed.
Figure 13:
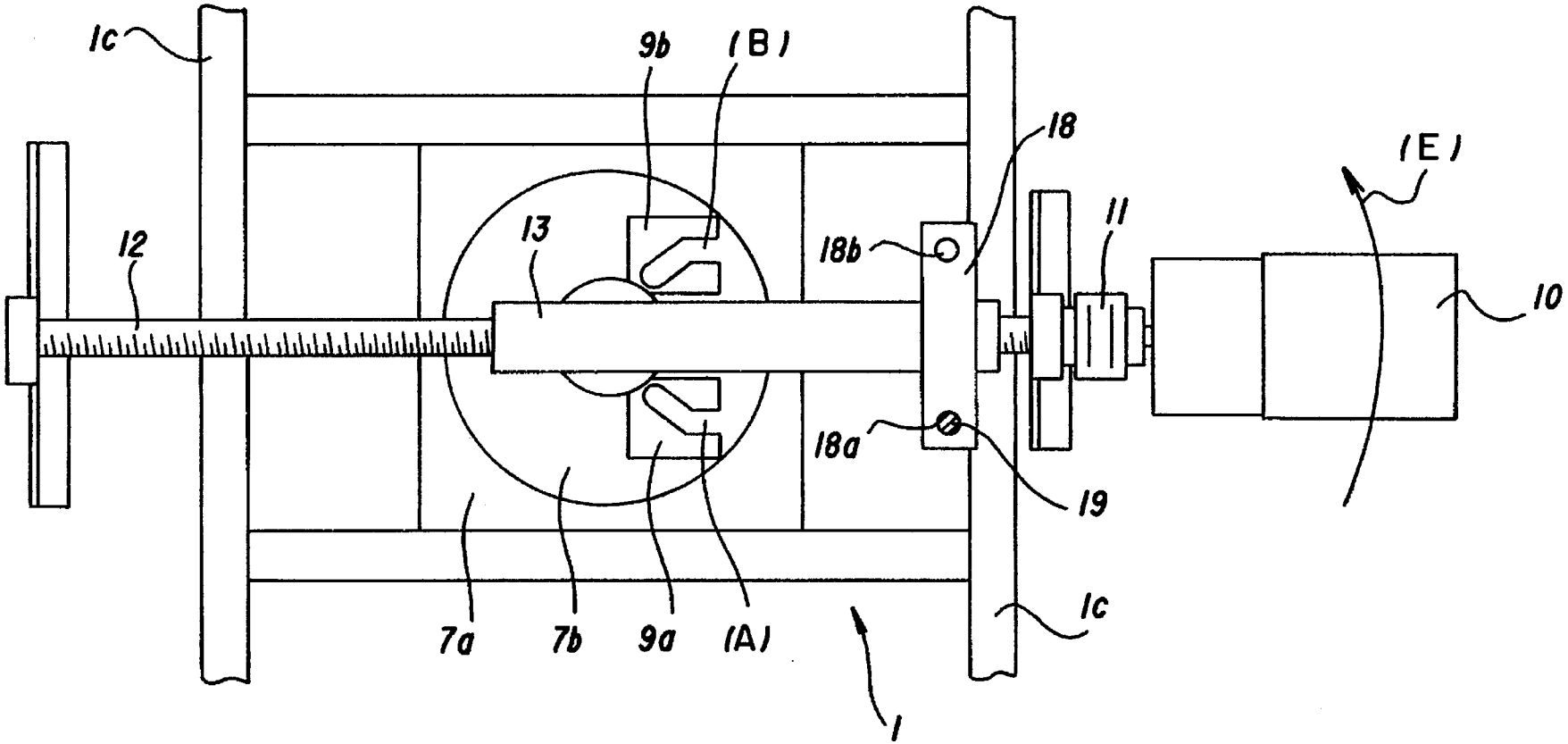
FIG. 13 is a plan view showing the pivoting process of the pivoting frame actuating mechanism.
Figure 14:
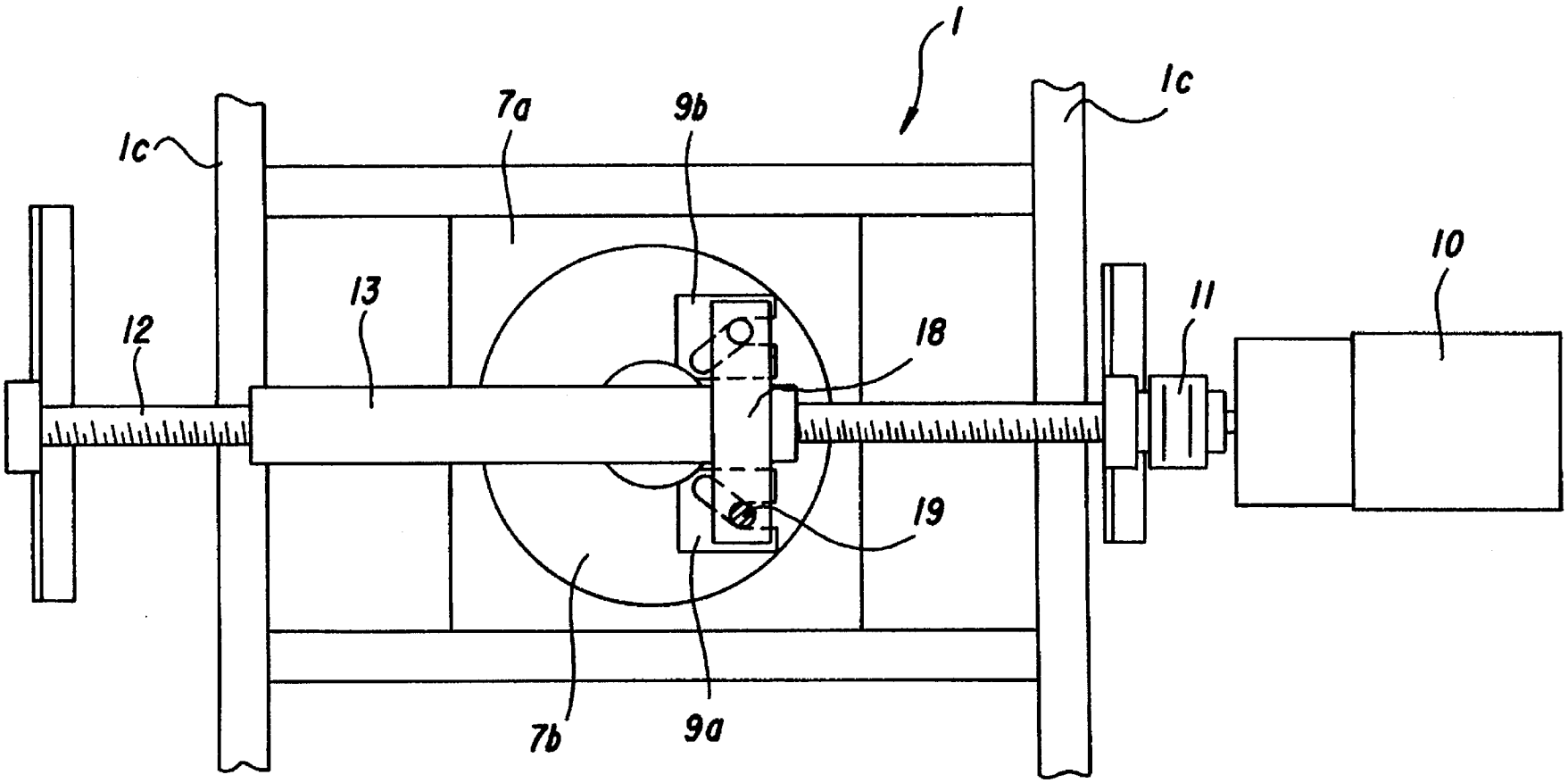
FIG. 14 is a plan view showing the pivoting process of the pivoting frame actuating mechanism.
Figure 15:
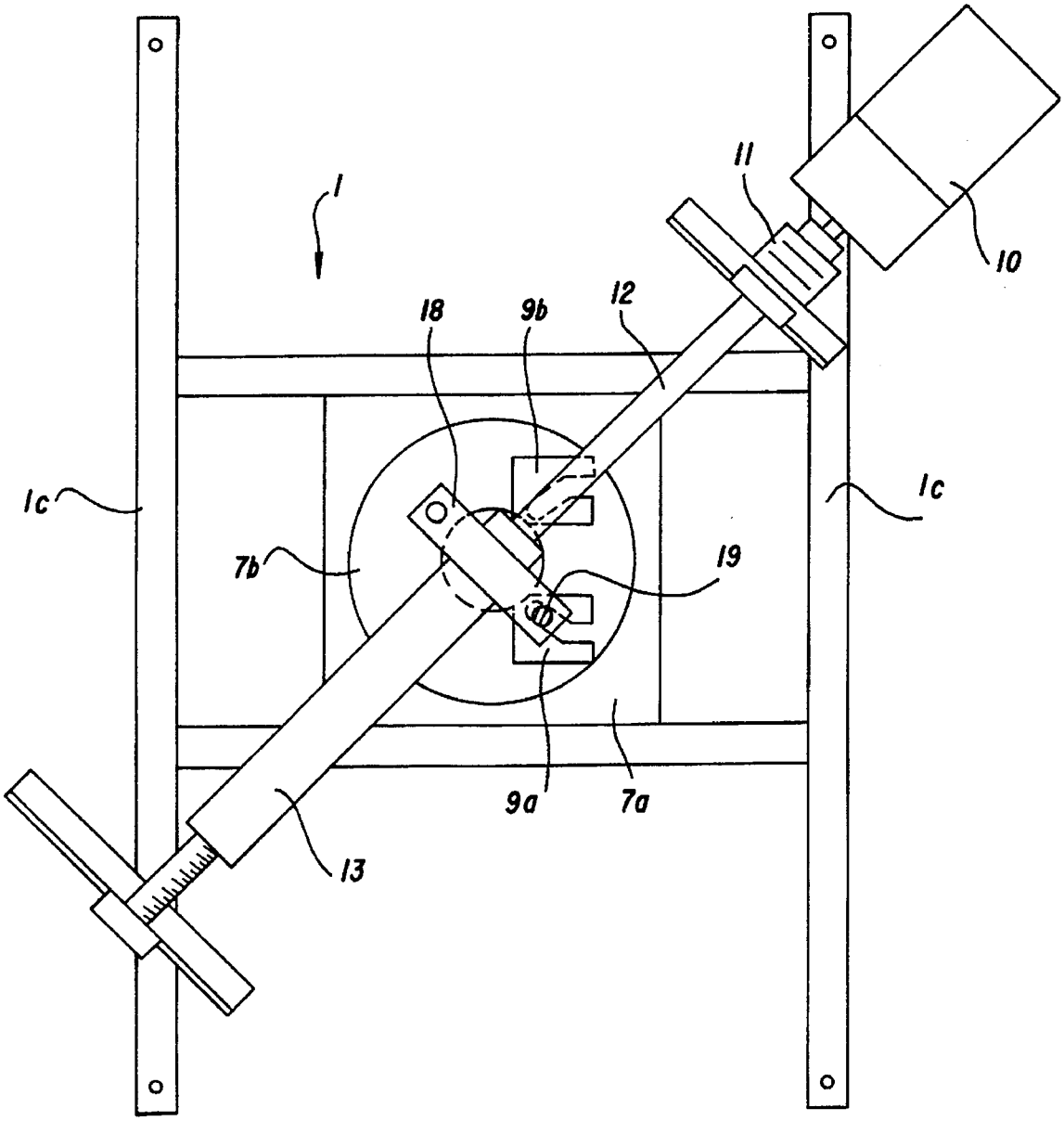
FIG. 15 is a plan view showing the pivoting process of the pivoting frame actuating mechanism.
Figure 16:
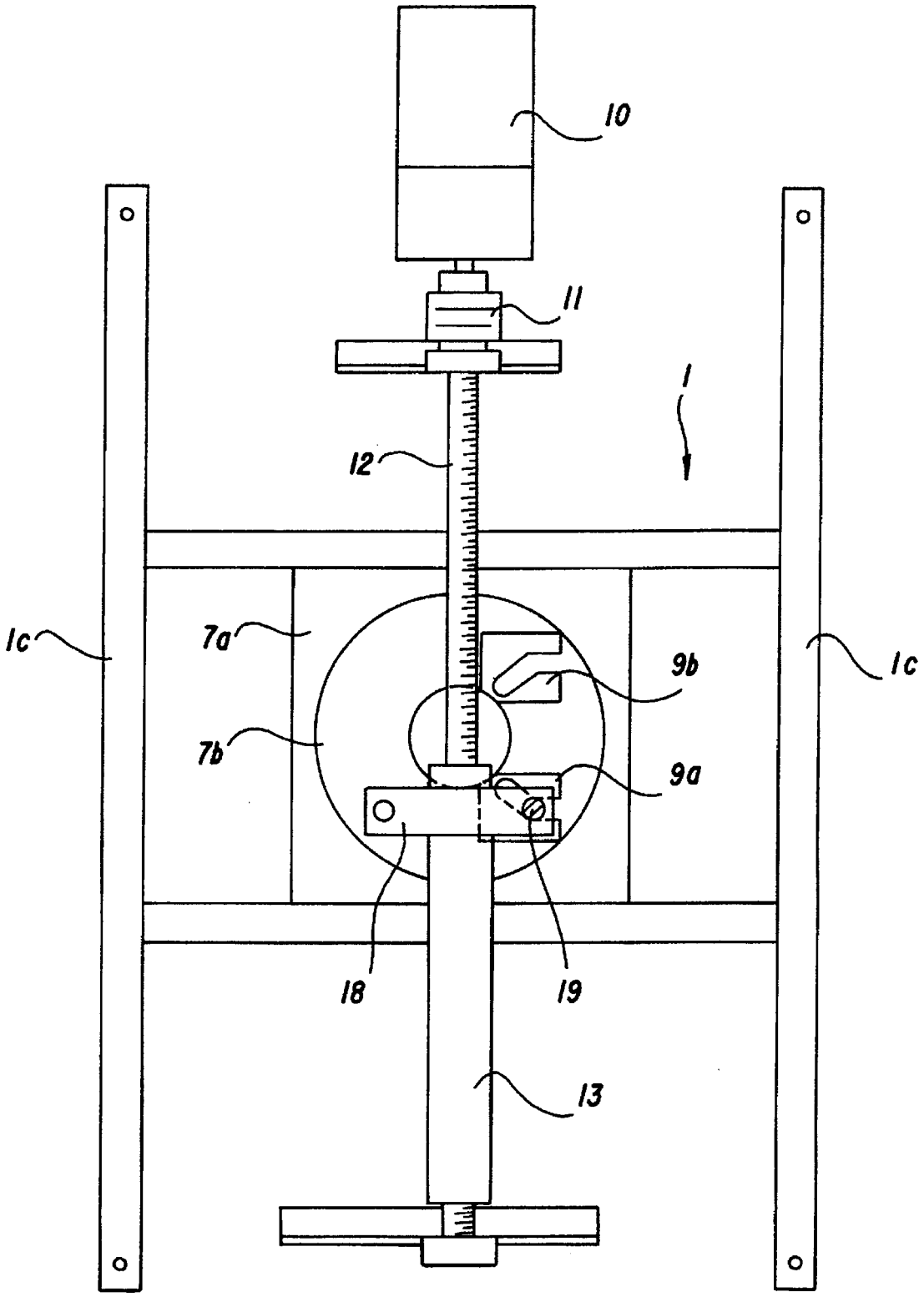
FIG. 16 is a plan view showing the pivoting process of the pivoting frame actuating mechanism.
Figure 17:
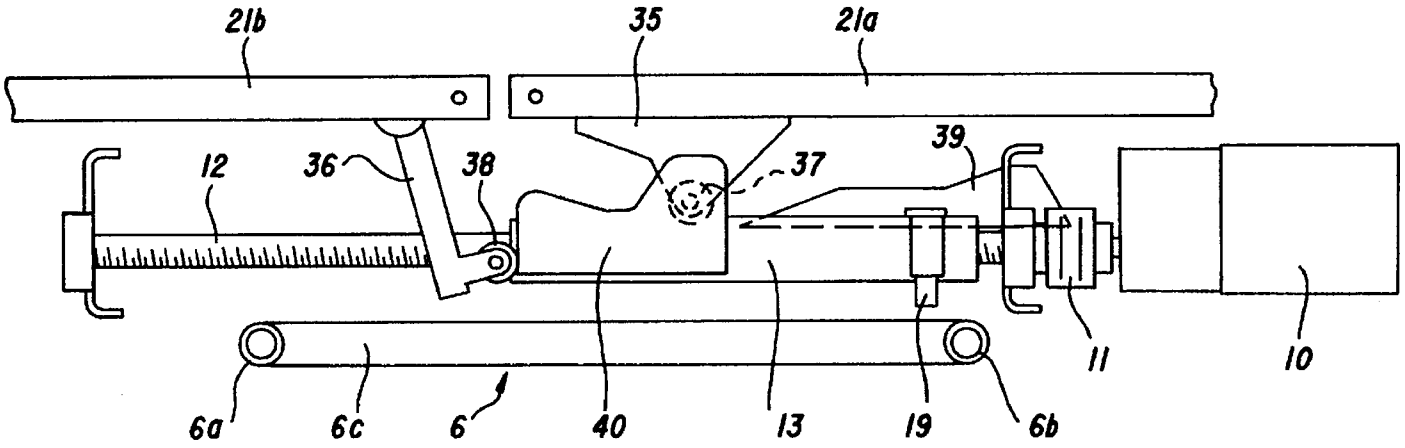
FIG. 17 is a side view of a principal part showing a bending process of a front bed section.
Figure 18:
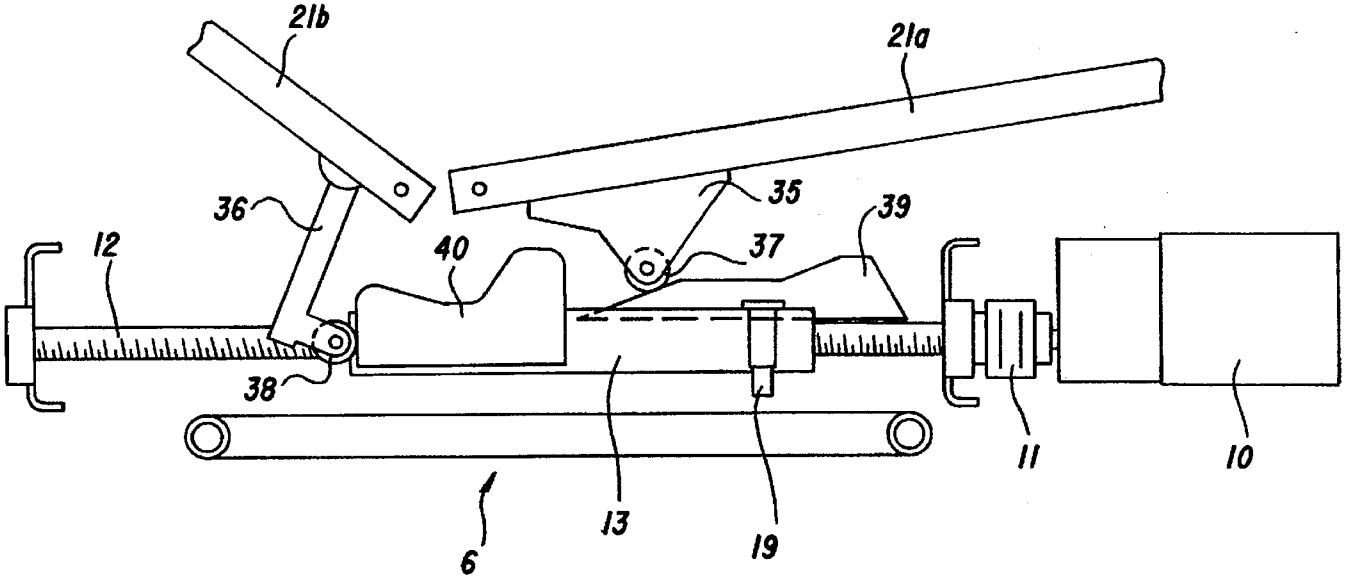
FIG. 18 is a side view of the principal part showing a bending process of the front bed section.

In FIG. 1, a fixed frame 1 of the bed is supported by front feet 2 and rear feet 3. When viewed from the side, its center part in the longitudinal direction descends, and when viewed from above, right and left side frames 1*a* and 1*b* are connected by joining frames 1*c* (see FIG. 13). Parts 4 and 5 are a front board and a rear board, respectively.

Figure 3:
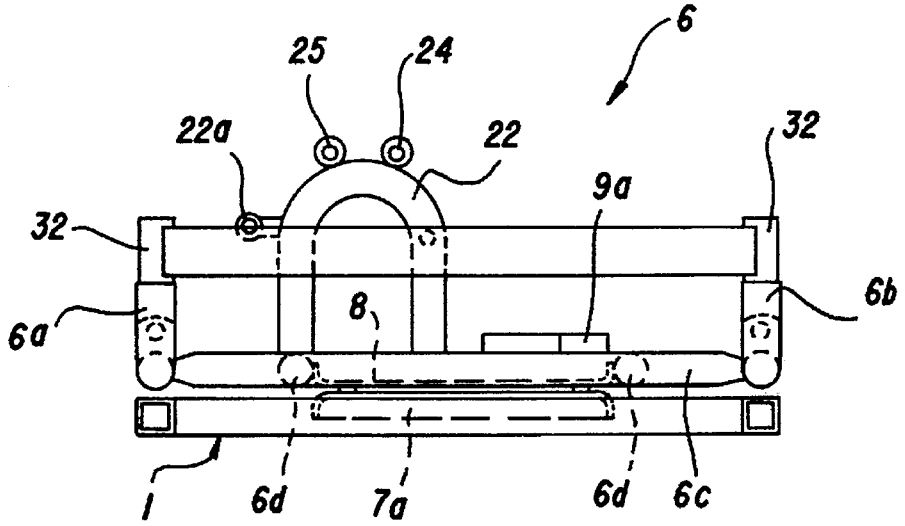
FIG. 3 is a side view of a pivoting frame.
Figure 4:
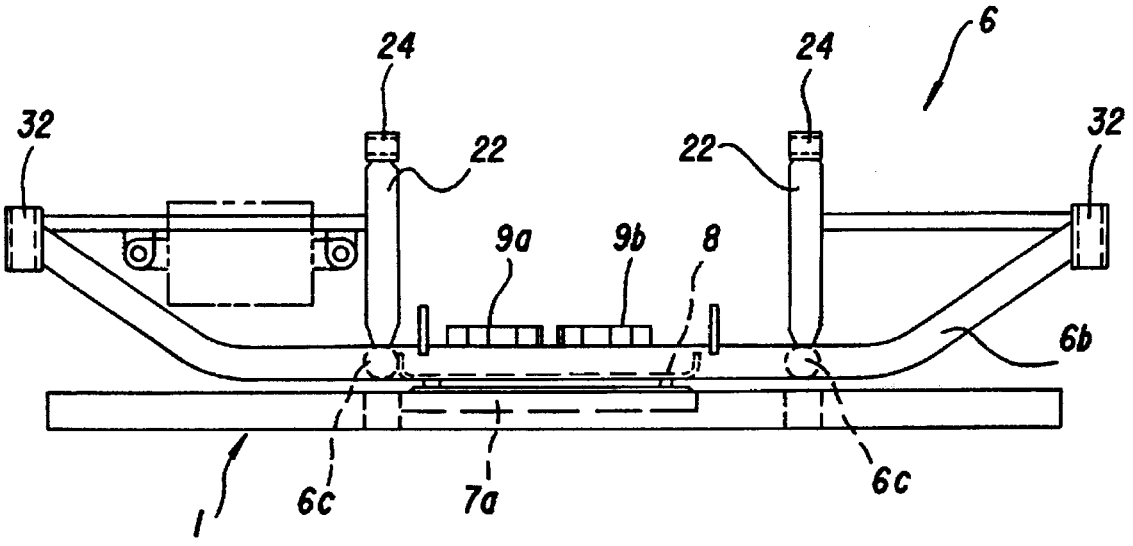
FIG. 4 is a side view of the pivoting frame.
Figure 5:
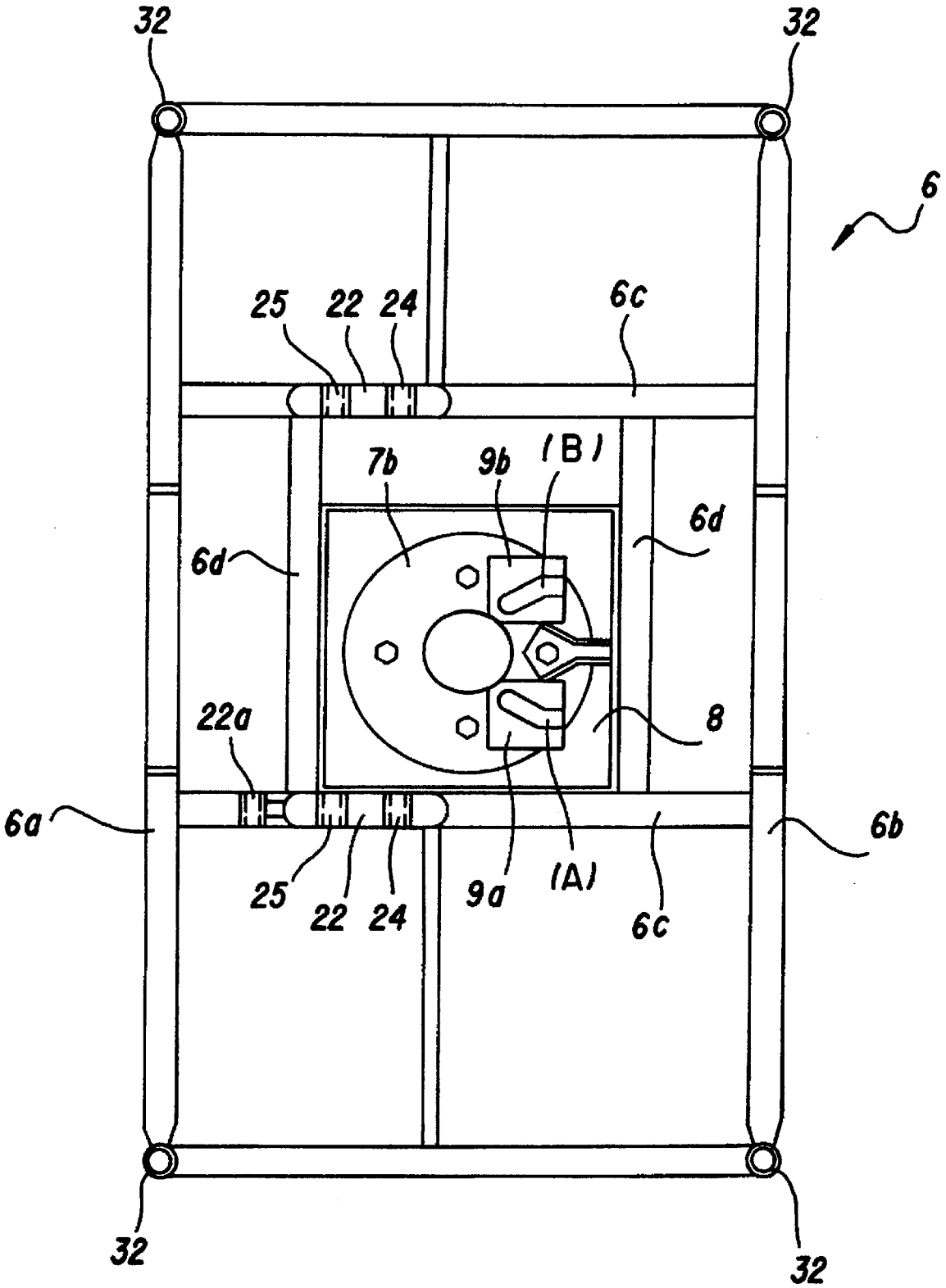
FIG. 5 is a plan view of the pivoting frame.

A pivoting frame 6 (see FIGS. 3–5) of the bed is fixed to a pivoting plate 8 which is held by upper and lower bearings between a lower fixed ring 7*a* fixed to the joining frame 1*c* located in the descending center part of the fixed frame 1. An upper fixed ring 7*b* is integrally fixed to the lower fixed ring 7*a* so that the pivoting plate 8 can pivot freely. The pivoting frame 6 comprises side frames 6*a* and 6*b* provided on the left and right sides of the bed in the longitudinal direction, two tie frames 6*c* for connecting to the pivoting plate 8, and a mounting frame 6*d* to which the tie frames 6*c* are connected.

The above-mentioned pivoting frame 6 has the pivoting mechanism as described below. At first, fixed cams 9*a* and 9*b* are fixedly secured on the right and left areas on the upper face of the fixed ring 7*b* in the protruded state, and the fixed cams 9*a* and 9*b* have cam grooves A and B, respectively, to displace the mating part inward from the back toward the front.

Figure 6:
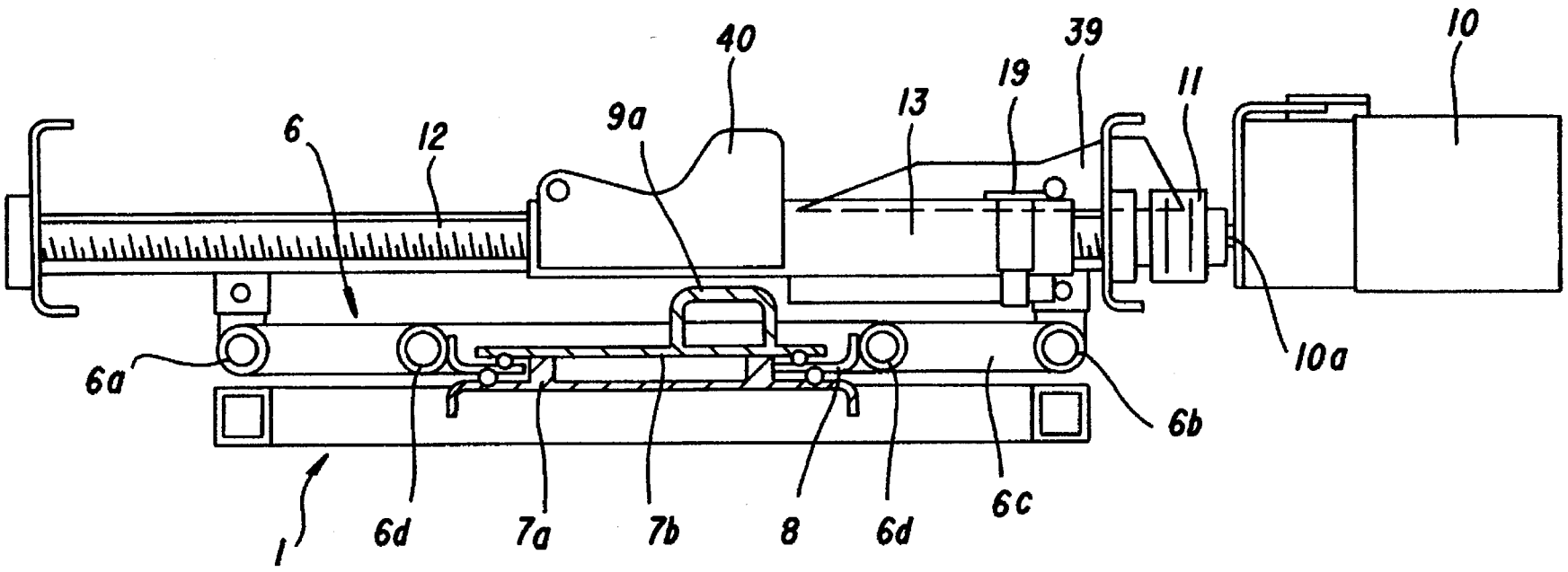
FIG. 6 is a side view of a principal part of a pivoting frame actuating mechanism.
Figure 7:
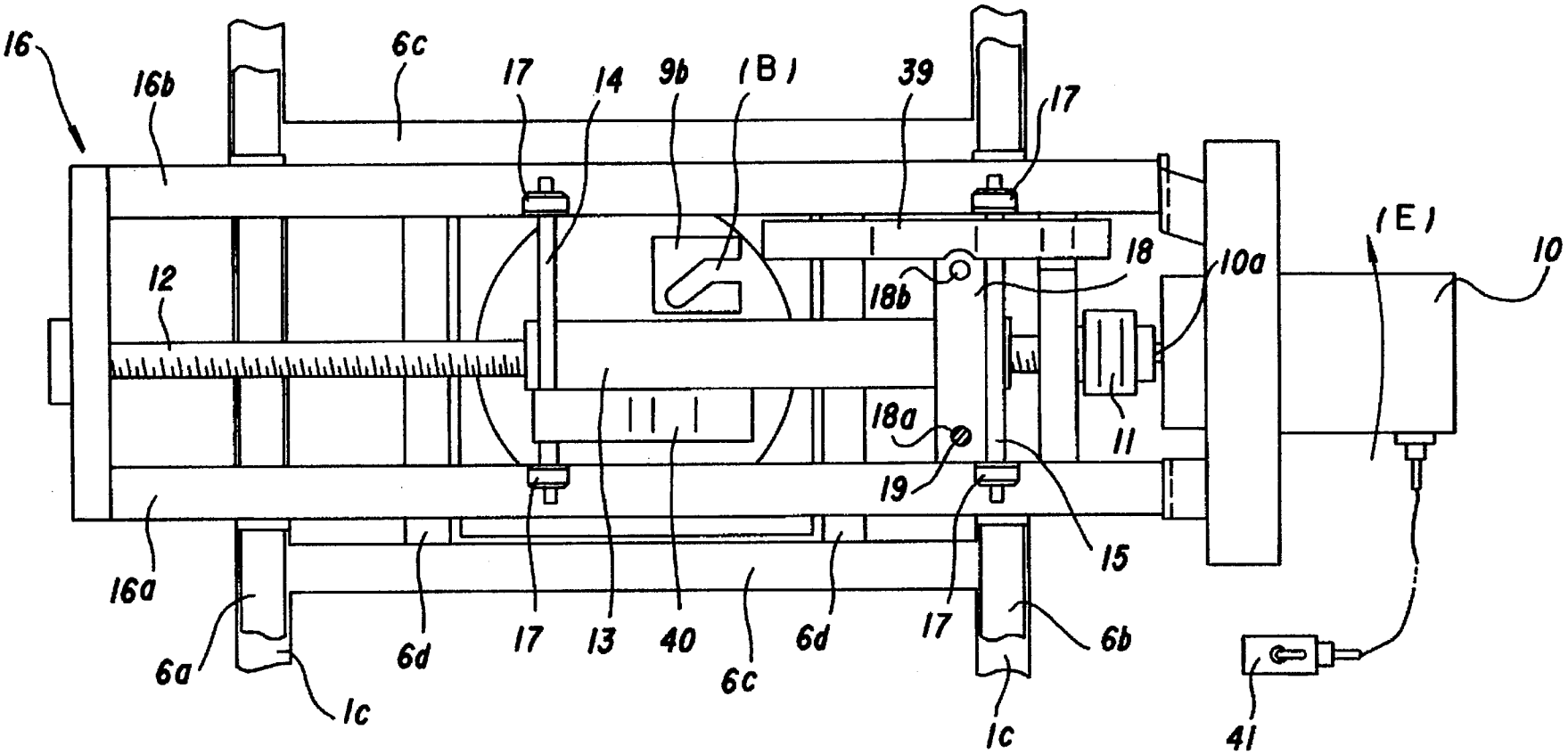
FIG. 7 is a plan view of the principal part.

On the other hand, the pivoting frame 6 is provided with an integrally fixed transmission mounting frame 16 having a rectangular shape when viewed from above (see FIGS. 6–7). A motor 10 is mounted in this frame 16 with the drive output shaft 10*a* set in the longitudinal direction, and a screw shaft 12 is connected to the shaft 10*a* in the longitudinal direction through a friction transmission joint 11 serving also as a shock absorber. The screw shaft 12 is received on bearings of the transmission mounting frame 16 so that the shaft can freely pivot. A screw cylinder 13 is screwed onto the screw shaft 12 and provided with shafts 14 and 15 on the right and left sides to prevent the shaft 13 from rotating. The shafts 14 and 15 are provided with rollers 17 which roll on the right and left frames 16*a* and 16*b* of the frame 16, keeping contact with them.

A lateral frame 18 has holes 18*a* and 18*b* on the right and left ends, to one of which cam pin 19 is inserted. When the pin 19 is inserted into the hole 18*a* or 18*b* on the lateral frame 18 and the motor is started to move the screw cylinder 13 forward, the lower end of the pin 19 is fitted into the cam groove A (cam 9*a*) or B (cam 9*b*) and pivots the pivoting frame 6 rightward or leftward through the transmission mounting frame 16 in cooperation with the motor 10 (see FIGS. 13–16). Rotating the motor 10 reversely to move the screw cylinder 13 backward draws out the pin 19 backward from the cam groove A or B, and the cam action obtained in this time causes the pivoting frame 6 to pivot in the reverse direction to the above-mentioned direction to return to its origin. The pivoting angle of the pivoting frame 6 varies depending on the displacement angle and length of the cam grooves A and B. In this invention, the cam grooves are designed so that the friction transmission joint 11 functions to stop the pivoting frame 6 when it pivots approximately 90°.

Figure 8:
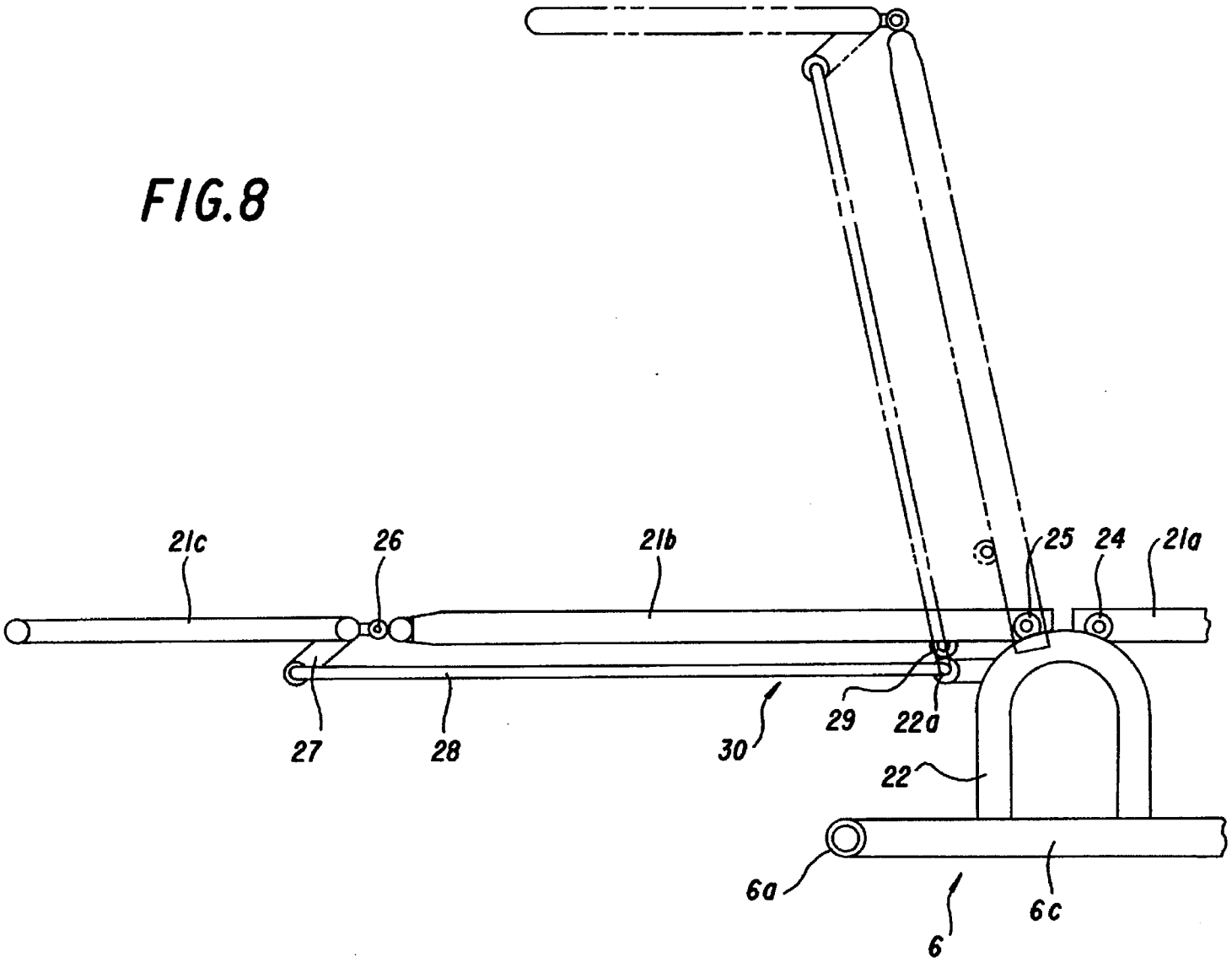
FIG. 8 shows how a posture change-over means operates.
Figure 9:
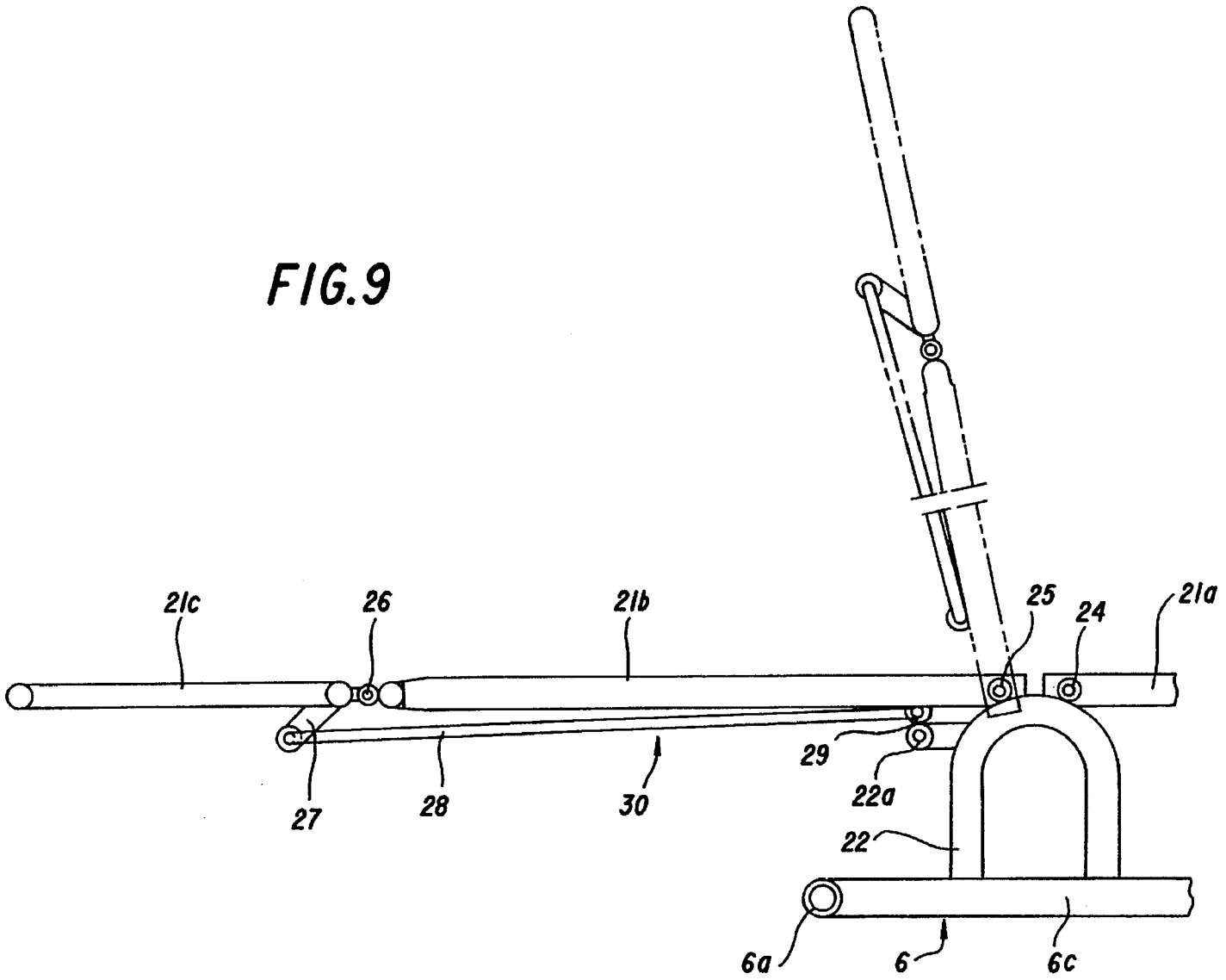
FIG. 9 shows how the posture change-over means operates.

The pivoting frame 6 is connected with the front bed supporting frame 21 supporting the front bed section 20*a* for receiving the upper part of a person's body above the femur as follows; the pivoting frame 6 is provided with a reverse U-shaped protruding frame 22 (see FIGS. 8–9) which has brackets 24 and 25 to fit the waist supporting frame 21*a* and the back supporting frame 21*b*, respectively. The base sides of the supporting frames 21*a* and 21*b* are secured with pins 23 so that they can pivot freely, and their moving ends are properly supported by the pivoting frame 6 so that the frames are kept substantially horizontally. Also, the head supporting frame 21*c* is fitted to the front of the back supporting frame 21*b* so that the frame 21*c* can pivot freely with the aid of a pin 26. The front of a protruding arm 27, under the head supporting frame 21*c*, is connected to the bracket 22*a* on the protruding frame 22 through a rod 28. When the back supporting frame 21*b* is pivoted upward, only the head supporting frame 21*c* is kept in the horizontal posture. When the base of the rod 28 is connected to the bracket 29, fixed on the back supporting frame 21*b*, the head supporting frame 21*c* is not kept horizontal when the back supporting frame 21 is pivoted; it moves together with the back supporting frame 21*b*. Thus, a posture change over means 30, for changing the posture of the head supporting 21*c* by changing the mounting position of the rod 28, functions between the back supporting frame 21*b* and the head supporting frame 21*c*.

Figure 10:
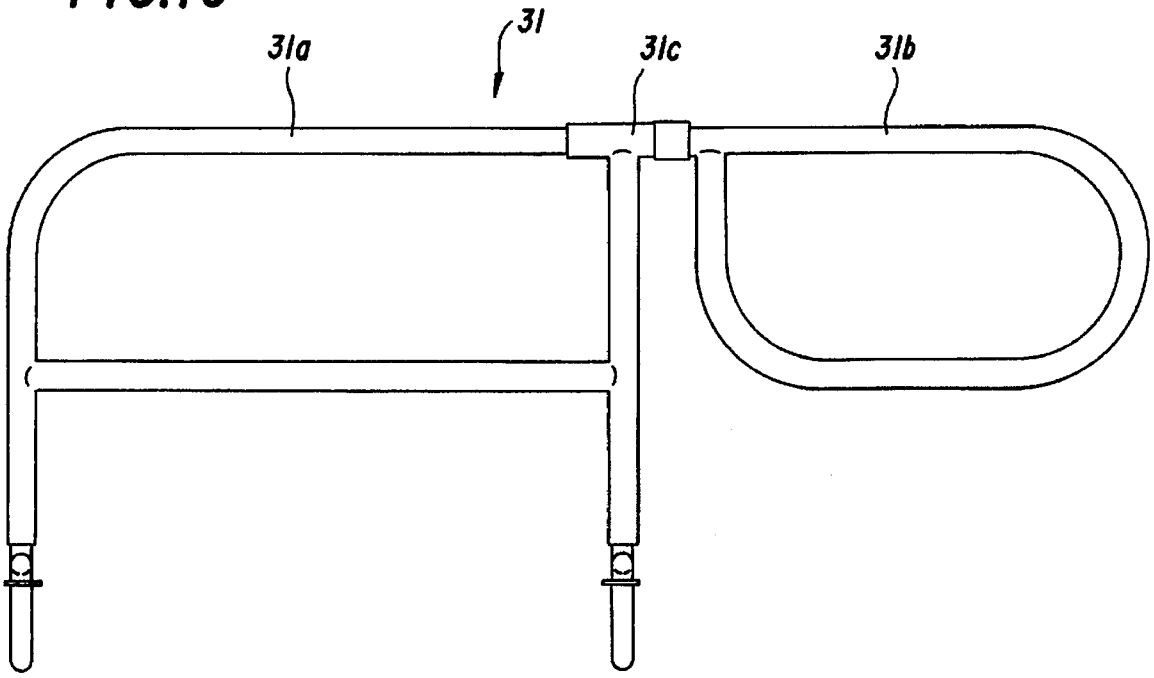
FIG. 10 is a side view of a handrail.
Figure 11:
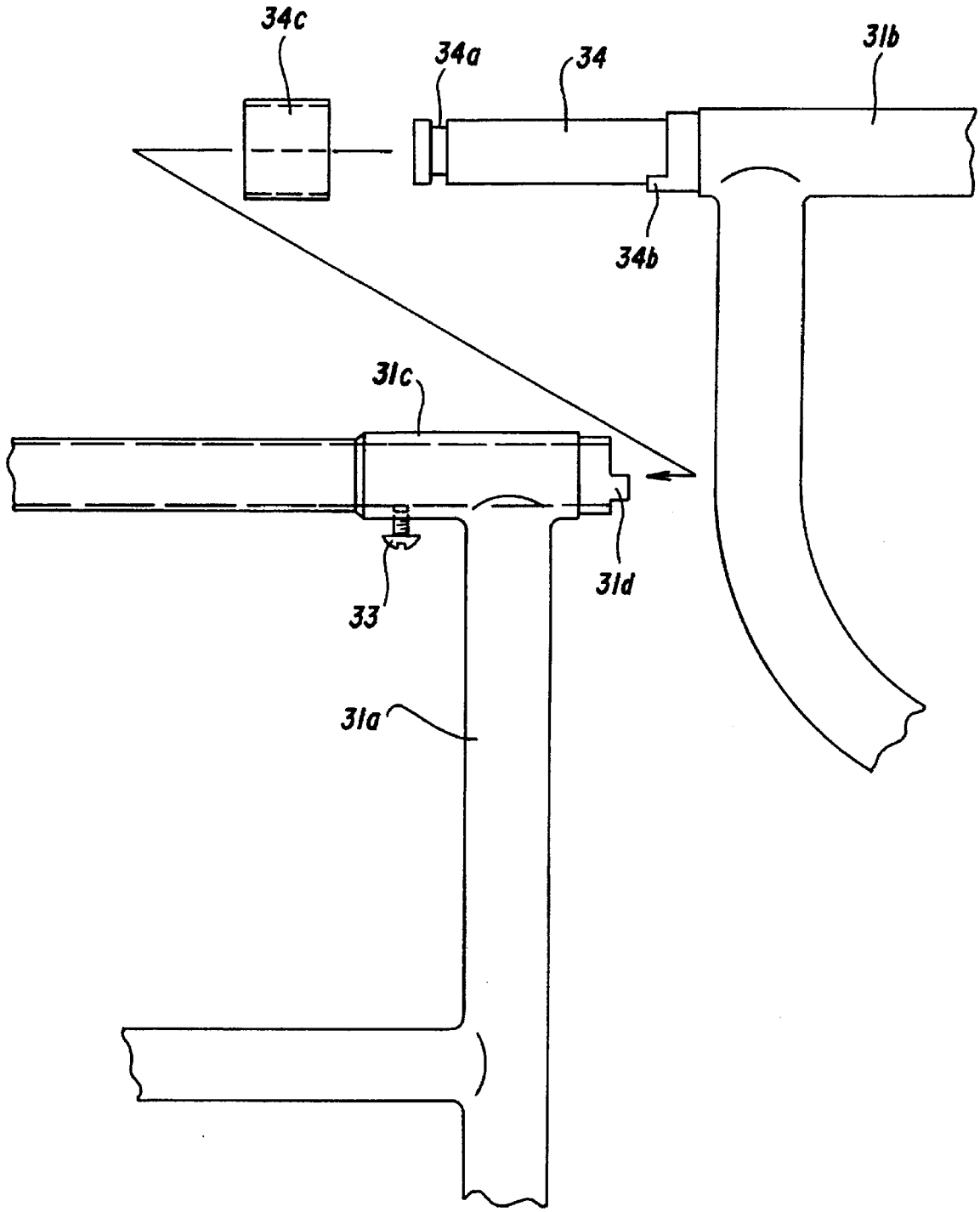
FIG. 11 is a side view of a pivoting mechanism of the handrail.

Cylinders 32 are provided on the four corners of the pivoting frame 6 to attach handrails 31. The handrail 31 (see FIGS. 10–12) comprises a gate-shaped fixed handrail 31*a* which is inserted into the cylinders 32 from above and a pivoting handrail 31*b* which is inserted into the handrail 31*a* in the longitudinal direction through a boss 31*c* integrally secured on the rear upper part of the fixed handrail 31*a* and held with a screw 33 and a drawing-out preventive groove 34*a* cut on an insertion shaft 34. The pivoting handrail 31*b* is made of a pipe which is formed in a substantially elliptical loop and designed so that it can be set in two positions, i.e. in the hanging-down position and in the slanting position (at which it is held inward and slightly slanting), by means of pivoting stoppers 31*d* and 34*d* provided on the boss 31*c* and the pivoting handrail 31*b* at the end face of the insertion shaft 34, respectively.

A cylinder 34*c* is a safety cover for the stopper section. The front bed section 20*a* has an ordinary bendable bed mat, which is placed on the upper surface of the front bed supporting frame 21 set on the pivoting frame 6 as described above. The rear edge of the front bed section 20*a* is formed in a circular arc which has radius extending from a center of the pivoting frame 6.

The rear bed section 20*b* is placed on the upper surface on the rear side of the fixed frame 1. The front edge is formed in a circular arc traced with a radius extending from a center of the pivoting frame 6. The projections C and D on the right and left sides of the bed section 20*b* having an arched edge when viewed from above are inclined gradually lower than the other surfaces toward the ends.

Below is explained the pivoting mechanism of the waist supporting frame 21*a* and the back supporting frame 21*b* mounted on the pivoting frame 6 through the protruding frame 22 so that they can pivot. Under the supporting frames 21*a* and 21*b*, cam rollers 37 and 38 are fitted through brackets 35 and 36 (see FIGS. 17–21), respectively, so that they can roll through lateral shafts. Also, a cam 39, with which the cam roller 37 is put into contact, is fixed on the right side of the lateral frame 18 integrally secured to the screw cylinder 13. A cam 40 with which the cam roller 38 is put into contact, is fixed on the left side. When the screw cylinder 13 is moved forward by rotating the screw shaft 12 by the motor 10, the cam roller 38 is pushed by the vertical front face of the cam 40 to cause the back supporting frame 21*b* to pivot gradually backward, and, almost simultaneously, the cam roller 37 is gradually moved up by the cam 39 to cause the rear side of the waist supporting frame 21*a* to pivot somewhat upward. Then, a few seconds before the condition shown in FIG. 19 occurs, the cam pin 19 inserted into the hole 18*a* or 18*b* at the end of the lateral frame 18, is fitted into the cam groove A or B of the fixed cam 9*a* or 9*b* on the side where the pin is located. After this, the screw cylinder 13 moves forward, and when the pin 19 reaches the displacing zone of the cam groove, the pivoting frame 6 starts pivoting to the left or right. When the pivoting frame pivots approximately 45°, the back supporting frame 21*b* is turned down slightly, and at the same time the waist supporting frame 21*a* gradually becomes sharp in inclination while the pivoting frame 6 further pivots. Then, when the pivoting frame 6 reaches the pivoting limit of approximately 90°, the back supporting frame 21*b* is set in the vertical position, and the waist supporting frame 21*a* returns to the horizontal position. The positional relation between cams and pins or cam rollers and the shape of cams are designed so that the above-mentioned movements can be obtained.

A switch box 41 (see FIG. 7) to operate the motor 10 is provided with a cord so that a handicapped person, or aged person on the bed or a person who looks after him/her can operate the motor from any position and change the switch to rotate the motor 10 in the regular or reverse direction, i.e. to change the rotation direction of the screw shaft 12 to move the screw cylinder 13 forward or backward.

Figure 2:
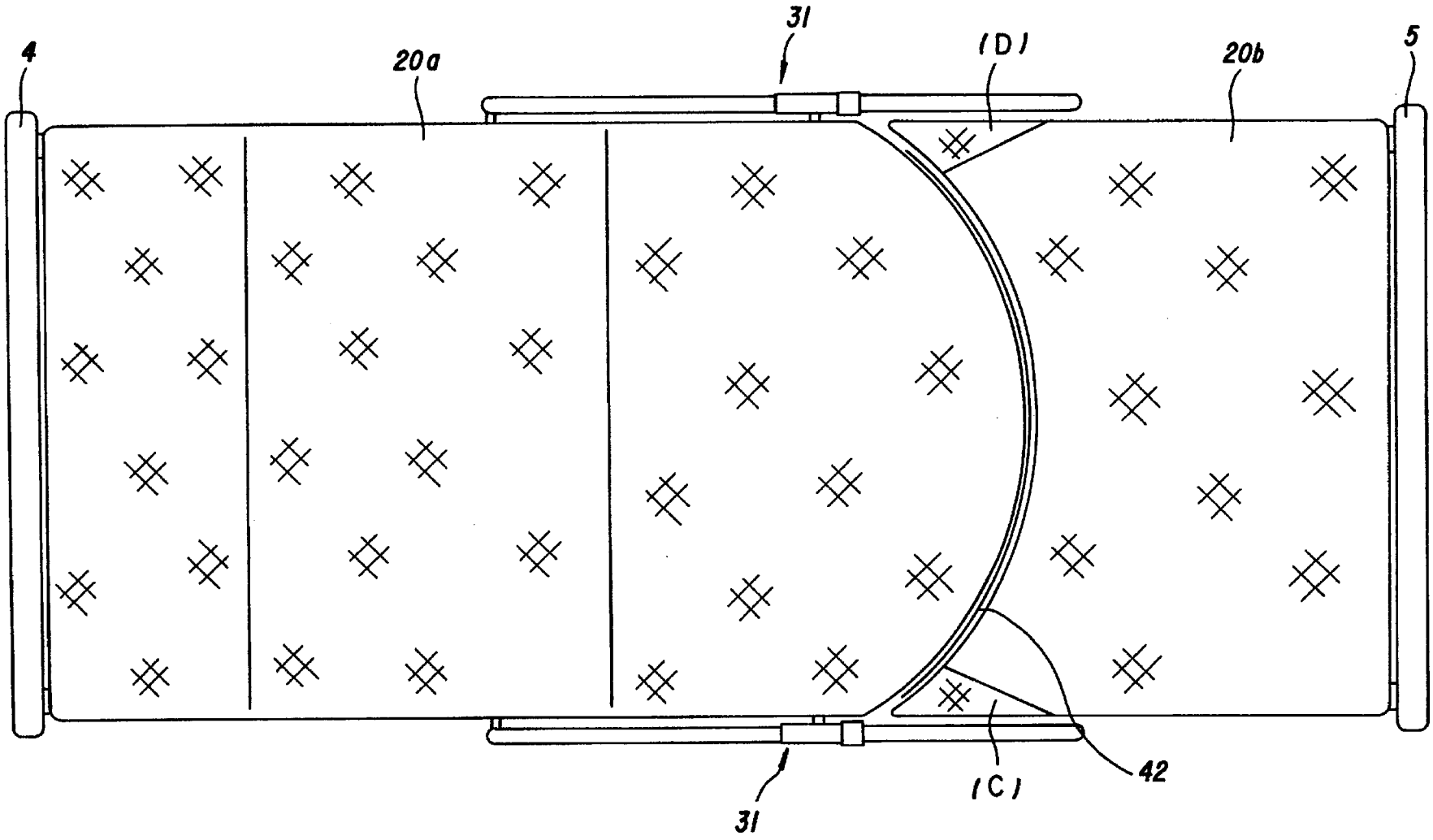
FIG. 2 is a plan view of the whole bed.

A slide member 42 (see FIGS. 2 and 22) made of leather or synthetic rubber is applied to the arched face of the front bed section 20*a* (convex edge) or the rear bed section 20*b* (concave edge) or to both the faces to pivot the section 20*a* smoothly.

The mechanism of the above-mentioned embodiment is described below.

Figure 19:
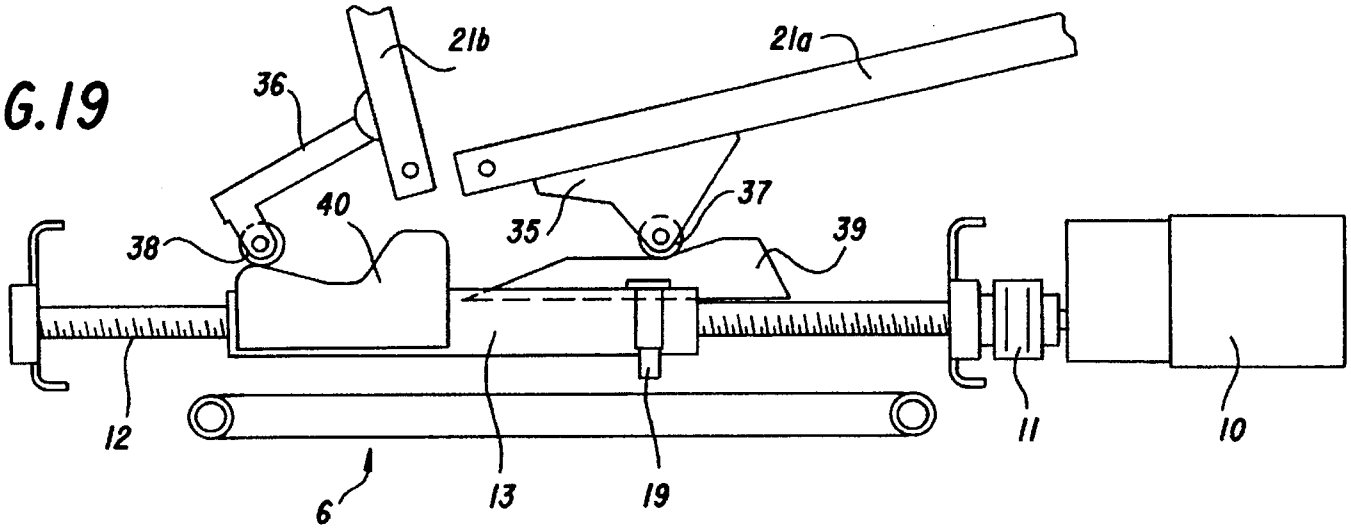
FIG. 19 is a side view of the principal part showing a bending process of the front bed section.
Figure 22:
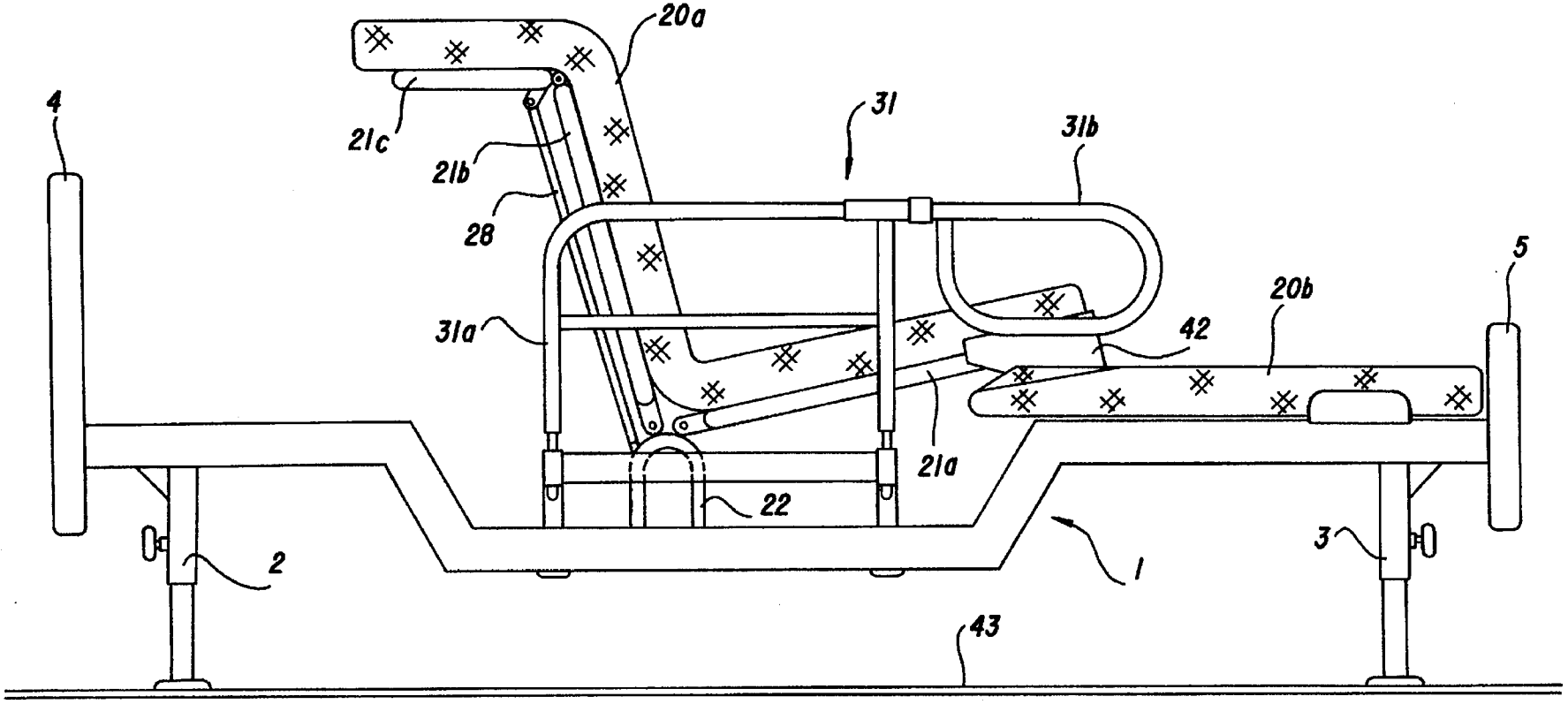
FIG. 22 is a side view of the whole bed in the raised state.
Figure 23:
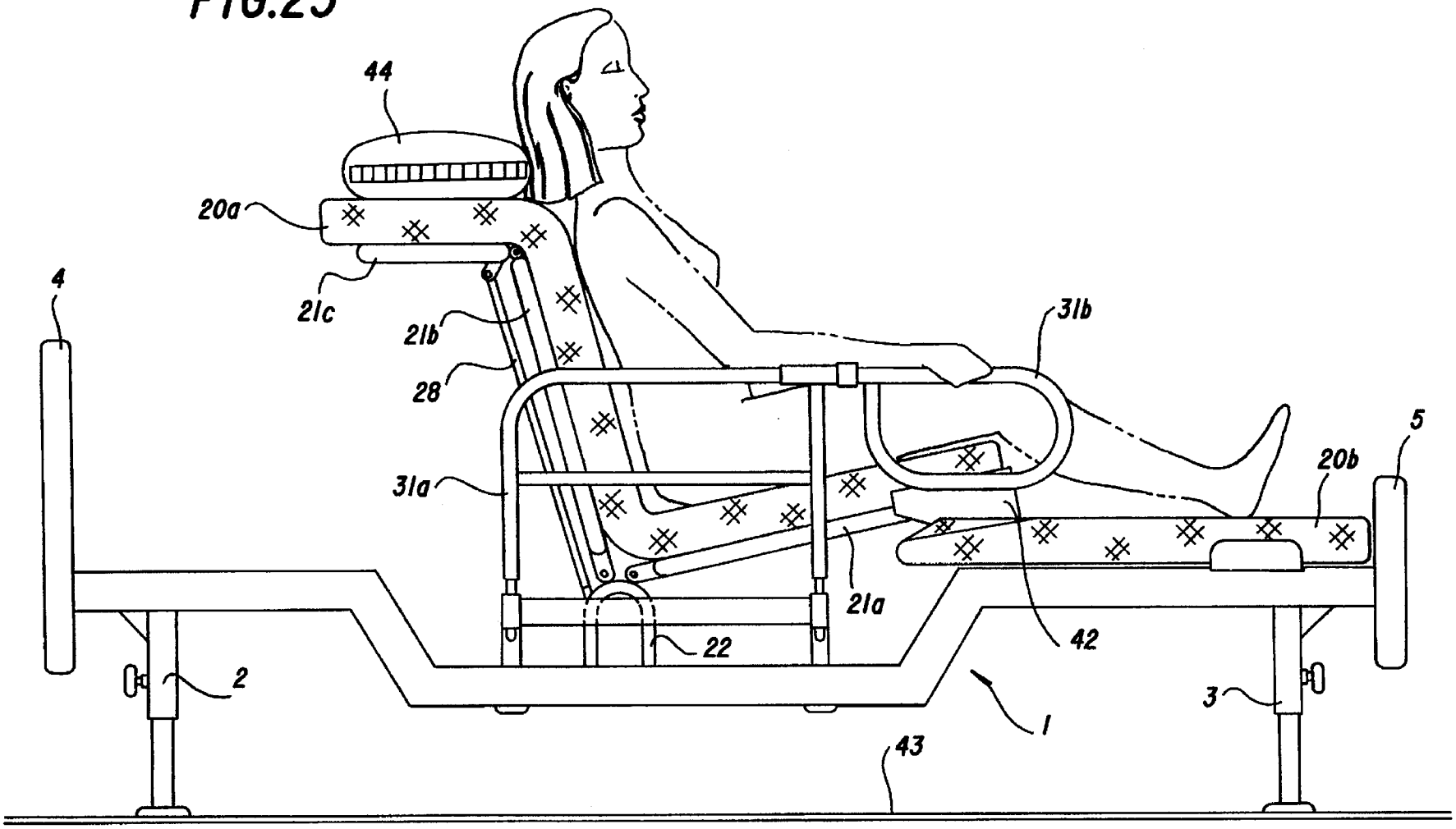
FIG. 23 is a side view of the bed when a person on the bed is in the posture to take a meal or when the bed is in the pivoting start position.

A handicapped person or an aged person is laid on the bed with the upper half of the body above the waist on the front bed section 20*a* and with the legs on the rear bed section 20*b*. When he/she wants to raise his/her upper part of body from the lying posture to take a meal, to come down on the right side (left side with respect to the person lying on his/her back) floor 43 or to be held or carried on his/her back by a person standing at the right side of the bed, the cam pin 19 should be inserted into the left hole 18 of the lateral frame 18 beforehand as shown in FIGS. 6 and 7, and the screw shaft 12 should be rotated counterclockwise by the motor 10 to move the screw cylinder 13 forward. Then, first the cam roller 37, fitted to the waist supporting frame 21*a* through the bracket 35, is moved up by the cam 39. At the same time the cam roller 38, fitted to the back supporting frame 21*b* through the bracket 36, gets into contact with the front face of the cam 40, so that the supporting frames 21 and 21*b* are pivoted as shown in the operation processes shown in FIGS. 17 to 19 and the person on the bed is moved into the posture to take a meal or read a book as shown in FIGS. 22 and 23. To simply raise the person on the bed to such a posture, the cam pin 19 need not be inserted into the hole 18*a* or 18*b*. Next, when the motor 10 is further rotated to move the screw cylinder 13 forward, the cam pin 19 gets into contact with the displacing zone in the cam groove A of the left fixed cam 9*a* provided on the bed fixed frame 1, and the frame 16 on which the motor 10 is mounted and the pivoting frame 6 integrally fixed to the frame 16 pivots rightward (in the arrow E direction) with respect to the fixed frame 1 from the state shown in FIG. 13 to the state shown in FIG. 16 through the states shown in FIGS. 14 and 15. In the state shown in FIG. 15, during pivoting movement, the cam rollers 37 and 38 and the cams 39 and 40 are located as shown in FIG. 19. As the screw cylinder 13 is moved further forward, the pivoting frame 6 and the driving section, including the motor pivot approximately 45° from the state shown in FIG. 15 to the state shown in FIG. 16, i.e. pivoted approximately 90° from the initial position. During the second pivoting movement of about 45°, the positional relation between the cam rollers 37 and 38 and the cams 39 and 40 is changed from the state shown in FIG. 19 to the state shown in FIG. 21, while the back supporting frame 21*b* pivots slightly backward, the rear side of waist supporting frame 21*a* becomes slightly higher simultaneously, and, after this, the back supporting frame 21*b* stands up again, and, at the same time, the waist supporting frame 21 is set to the horizontal state, i.e. the lying person is finally set to the posture shown in FIG. 24 through the posture shown in FIG. 23.

Figure 24:
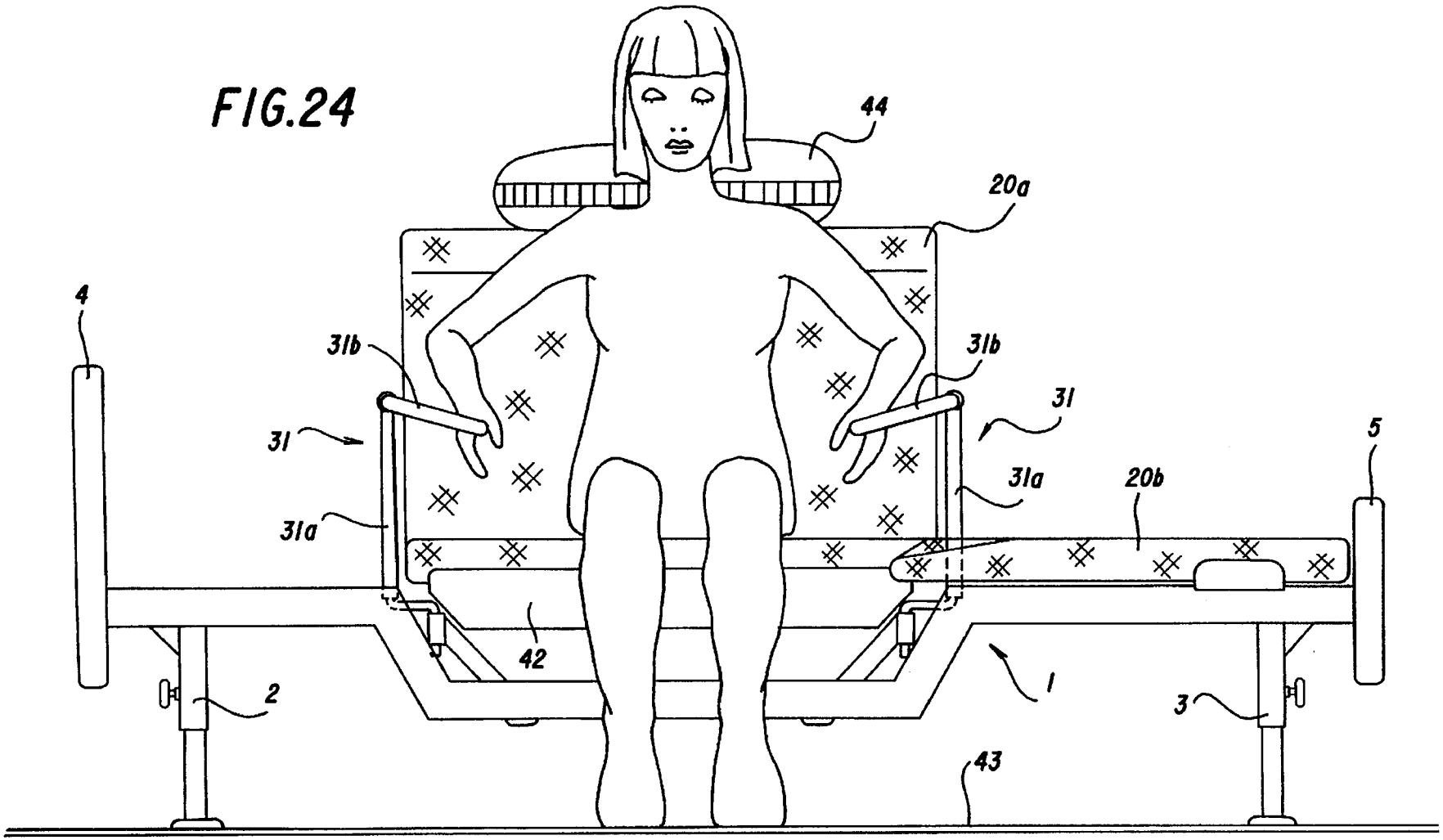
FIG. 24 is a side view of the bed when the pivoting frame has completed pivoting and a person on the bed is going to go down on the floor.

The bed can be returned from the position shown in FIG. 24 to the original horizontal position by rotating the motor 10 clockwise (in the reverse direction to the above-mentioned direction). In this case, completely reverse operation to the above-mentioned is performed, so that the person is returned to the lying posture. To move the pivoting frame 6 reversely so that the person on the bed can get down at the opposite side of the bed, the cam pin 19 should be inserted in the other hole 18*b* to fit it into the cam groove B of the fixed cam 9*b*.

Figure 12:
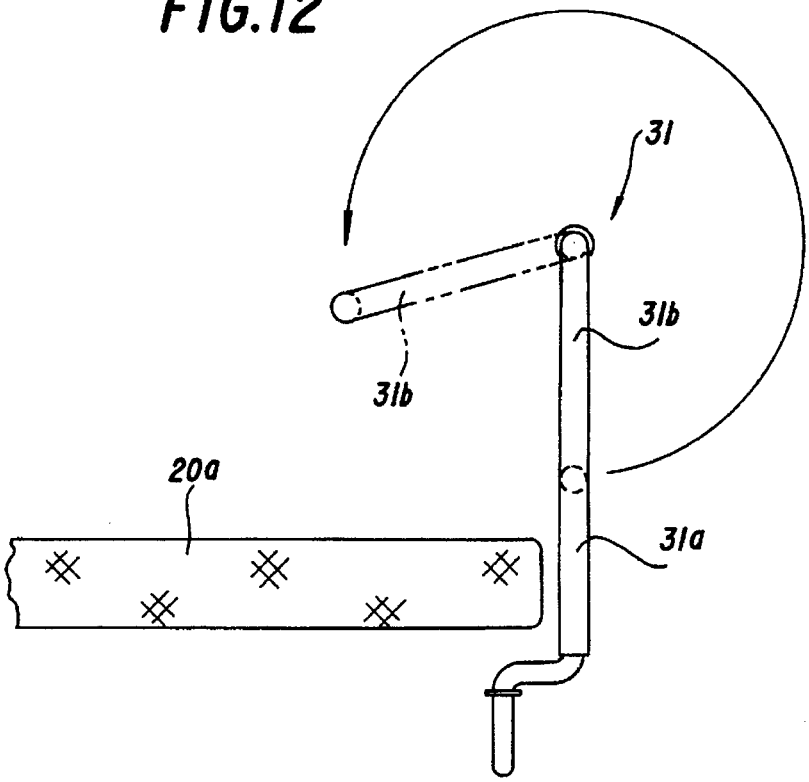
FIG. 12 is a front view of a principal part showing how the handrail pivots.
Figure 20:
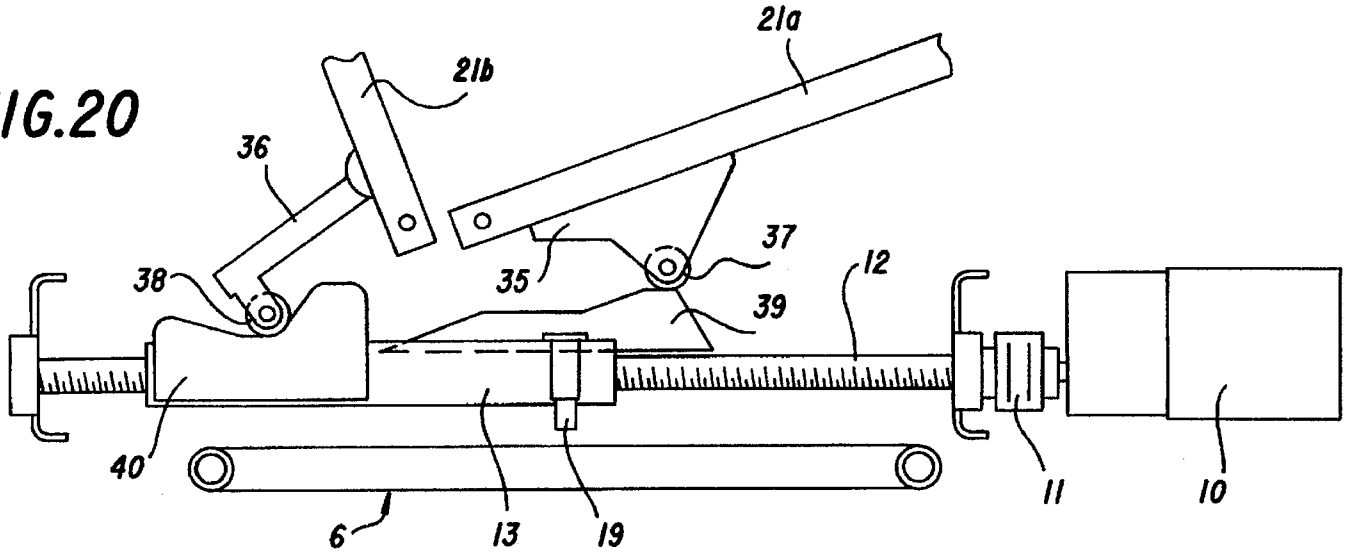
FIG. 20 is a side view of the principal part showing a bending process of the front bed section.
Figure 21:
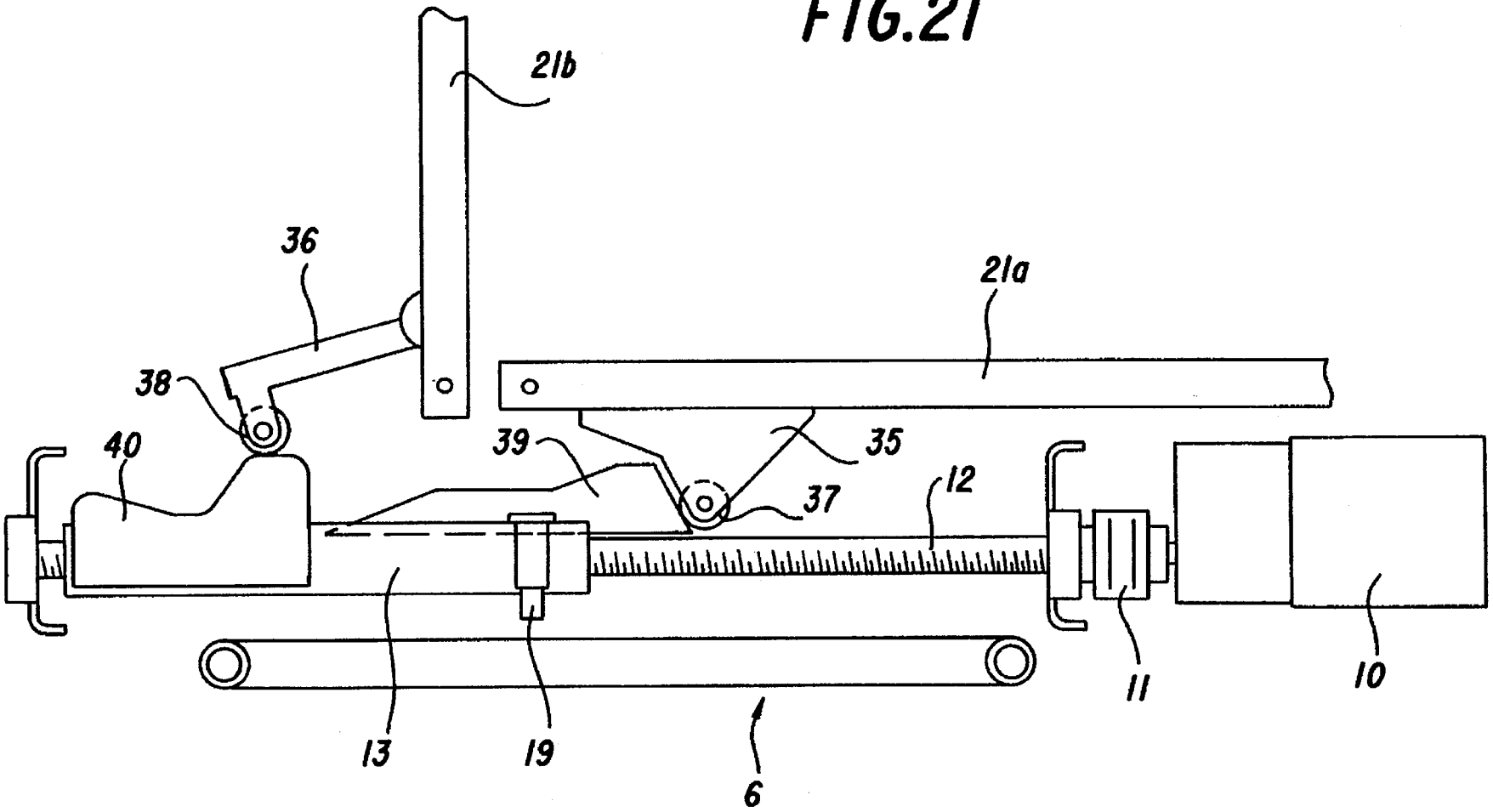
FIG. 21 is a side view of the principal part showing a bending process of the front bed section.

Accordingly, since waist supporting frame 21*a* and the back supporting frame 21*b* are operated as shown in FIGS. 19 to 21 as stated above during the operating processes of the front bed section 20*a* from FIGS. 23 to 24, the femur of a person on the bed near the waist, which is supported on the front of the waist supporting frame 12*a*, is slightly lifted a) to prevent his/her feet from being rubbed over the fixed rear bed section 20*b* while the front bed section is pivoting and b) to prevent the foot from twisting opposite to the pivoting direction by being caught by the fixed rear bed section 20*b*. At this time, if only the waist supporting frame 21*a* is lifted, the person on the bed is excessively bent and in pain. Therefore, this bed is designed so that the waist supporting frame 21*a* returns to the horizontal posture and stands up again after the back supporting frame 21*b* turns slightly backward. Accordingly, a person lying in the posture shown in FIG. 23 can raise his/her back and, finally, turn to the side of the bed to bring his/her feet onto the floor as shown in FIG. 24. Then, the pivoting handrails 31*b*, at the rear of the handrails 31, are operated as shown in FIG. 12 to pivot inward from above. The pivoting handrails 31*b*, therefore, come near the right and left hands of the person who wants to stand up from the posture shown in FIG. 24. Then, he/she can stand up easily by grasping the pivoting handrails 31*b* and sliding his/her body apart from the bed with the strength of his/her arms.

Also, when the end of the rod 28 has been connected to the bracket 22*a* of the protruding frame 22, the head supporting frame 21*c* is kept horizontal, therefore, as shown in FIGS. 23 and 24, the pillow 44 on the head supporting frame 21*c* is kept in place without falling even if the back supporting frame 21*b* is raised and pivoted.

An effect of this invention, as explained above, is that a head supporting frame is connected to the front of a back supporting frame so that the head supporting frame can be bent freely at the joint. A posture change-over means is designed so that the posture of the head supporting frame when the back supporting frame is raised and pivoted can be selected from two postures; a posture where the head supporting frame is kept horizontal and a posture where the head supporting frame and the back supporting frame form one plane. Therefore, in the latter case, the bed can be used in the same manner as previous beds capable of raising the upper body, and in the former case, a user can raise his/her upper body without dropping the pillow or articles even when he/she raises his/her back.

What is claimed is:

1. A bed capable of raising an upper part of a body of a physically handicapped or aged person lying on the bed comprising:

a waist supporting frame;

a back supporting frame;

a head supporting frame connected with a front of said back supporting frame, said head supporting frame being able to pivot at a joint between said head supporting frame and said back supporting frame so that said head supporting frame can be bent freely at the joint; and a posture change-over means for selecting a pivoting state of said head supporting frame when said back supporting frame is raised and pivoted, said pivoting state being a first state in which said head supporting frame is raised and pivoted on a same plane as said back supporting frame and a second state in which said head supporting frame is kept horizontal while said back supporting frame is pivoted.

2. A bed capable of raising the upper part of a body of a physically handicapped or aged person lying on the bed according to claim 1, wherein the posture change-over means has a fixed end of a rod connected to a protruding arm located under the head supporting frame and another end of said rod fitted to a bracket mounted on the pivoting frame or a bracket located under the back supporting frame.

* * * * *